United States Patent [19]

Arakatsu et al.

[11] 4,022,686

[45] May 10, 1977

[54] FLOTATION PROCESS FOR COPPER ORES AND COPPER SMELTER SLAGS

[75] Inventors: Akira Arakatsu, Tokyo; Hajime Nakazawa, Ichikawa; Hiroshi Naruse, Kokubunji, all of Japan

[73] Assignee: Sumitomo Metal Mining Co., Limited, Japan

[22] Filed: Feb. 20, 1976

[21] Appl. No.: 659,965

[30] Foreign Application Priority Data

Mar. 15, 1975 Japan ..... 50-29474
Nov. 25, 1975 Japan ..... 50-140964

[52] U.S. Cl. ..... 209/166; 241/20
[51] Int. Cl.[2] ..... B03D 1/06
[58] Field of Search ..... 209/166, 167; 241/20, 241/24; 75/2

[56] References Cited

UNITED STATES PATENTS

| | | | |
|---|---|---|---|
| 1,801,318 | 4/1931 | Moses et al. | 209/166 |
| 2,724,500 | 11/1955 | Zimmerley et al. | 209/166 |
| 3,426,896 | 2/1969 | Baarson et al. | 209/167 |
| 3,819,048 | 6/1974 | Weimer | 209/166 |

*Primary Examiner*—Morris D. Wolk
*Assistant Examiner*—Arnold Turk
*Attorney, Agent, or Firm*—Watson, Cole, Grindle & Watson

[57] ABSTRACT

A flotation process in which copper ores or copper converter slags are ground and firstly have added thereto benzotriazole or alkyl benzotriazole as an activator and secondly one or more collectors selected from the group consisting of xanthates, dithiophosphates, thiocarbamate esters, dithiocarbamates, mercaptans and dixanthogens and further, if desired, a promoter such as kerosene, light oil, bunker oil or petroleum lubricant is added to improve the recovery for the flotation of copper ores or copper smelter slags.

9 Claims, 4 Drawing Figures

FLOTATION PROCESS FOR COPPER ORES AND COPPER SMELTER SLAGS

DETAILED DESCRIPTION OF THE INVENTION

The present invention relates to a flotation process for copper ores and copper smelter slags and, particularly to an effective flotation process for application to the treatment of copper oxide ores.

Natural copper ores are classified into two kinds; copper sulfide ores and nonsulfide copper ores. Among them, the copper sulfide ores are used mainly in the current copper production as the raw material. The copper sulfide ores can be easily floated in the flotation process by employing a frother together with a collector such as xanthates, dithiophosphates, thiocarbamate esters and the like to be concentrated from a low grade ore to a copper concentrate.

On the other hand, the nonsulfide copper ores can be classified into native copper and nonsulfide copper ores excluding native copper. The nonsulfide copper ores of importance as copper sources include carbonate ores such as malachite [$Cu_2(CO_3)(OH)_2$], azurite [$Cu_3(CO_3)_2(OH_2$] and the like; silicate ores such as chrysocolla [$CuSiO_3.2H_2O$] and the like; chloride ores such as atacamite [$Cu_2(OH)_3Cl$] and the like; sulfate ores such as chalcanthite [$CuSO_4.5H_2O$], brochantite [$Cu_4(SO_4)(OH)_6$], antlerite [$Cu_3(SO_4)(OH)_4$] and the like and oxide ores such as tenorite [CuO], cuprite [$Cu_2O$] and the like. Such nonsulfide copper ores are secondary minerals and are commonly called as copper oxide ores. In the present application, such nonsulfide copper ores will be referred to hereinafter as copper oxide ores according to the metallurgical custom. Especially important ores as copper sources are malachite, chrysocolla and brochantite from the standpoint of amounts in the natural deposits.

Native copper can be relatively easily recovered by flotation employing a dithiophosphate or thiocarbamate ester as a collector, whereas the copper oxide ores are difficult to recover, in general, by the flotation process.

A number of experimental attempts have been developed for the flotation of copper oxide ores. However, because of either the special and expensive chemicals used or the large amount of chemicals required for the flotation, such attempts have not been developed to the point of practical use. The only commercialized process is that comprising adding a sulfidizing reagent such as sodium sulfide, sodium hydrosulfide or phosphorus pentasulfide to copper oxide ore containing mainly malachite of relatively high grade to convert the surface of malachite to the sulfide and recovering by flotation of the resulting ore by employing a collector usable for the flotation of copper sulfide ores such as a xanthate, mercaptan or thiocarbamate ester. Such a process is referred to as a sulfidizing process. This process cannot, however, be applied to the flotation of all types of malachite ores. For example, when the crystallinity of the malachite is poor or when the malachite is so brittle that when it is ground excessively fine particles are produced, the flotation can be carried out only with difficulty and the recovery is too low to commercialize the process economically. When the malchite ore contains too much clayey minerals, the flotation is similarly carried out only with difficulty.

Moreover, it is necessary to very carefully adjust the addition of a sulfidizing reagent for converting the surface of malachite to the sulfide before subjecting it to flotation. In the case of insufficient addition of a sulfidizing reagent, the sulfidizing effect will be insufficient for obtaining a high recovery, whereas in the case of excessive addition, the pulp pH increases making flotation difficult. Since, however, the malachite content in crude ores is always fluctuating in the actual flotation operation, the process has a severe shortcoming in that the addition of a sulfidizing reagent in a proper amount is so difficult that a stabilized flotation cannot be achieved. Moreover, when the ore used contains copper sulfide mineral together with malachite, the copper sulfide minerals are depressed strongly by the presence of the sulfidizing reagent.

Such a sulfidizing process is thus not effective for the flotation of crysocolla. Hence, it may be said that no effective flotation process is available commercially for crysocolla.

Such a sulfidizing process may be applied to the ores other than malachite and crysocolla, but there are generally many more cases where the process is difficult to carry out than cases where the process is carried out easily. As stated hereinbefore, the conventional process for the flotation of copper oxide ores comprises employing a sulfidizing reagent to convert the surface of copper oxide ores to the sulfide and then subjecting similar flotation process to that used for copper sulfide ores, but the recovery of the copper oxide ores is restricted depending on the type, crystallinity and particle size of the copper oxide ores or the type and conditions of coexisting gangue minerals so that the process is conditioned that it is far from being a general process.

For these reasons, those ores containing copper oxide which cannot be recovered easily by the flotation process have been conventionally treated by an acid leaching process or a segregation process. However, the acid leaching process cannot be applied economically to ores containing carbonate minerals as gangue minerals, because of the excessive consumption of acid (sulfuric acid being used generally). Moreover, the acid leaching process has the disadvantage in that no gold nor silver contained in the ore can be recovered. The segregation process requires the roasting of ores to be treated at a temperature ranging from 800° to 900° C so increasing the treating cost that it has been applied only to some ores of high grade.

Accordingly, an object of this invention is to provide a flotation process which is capable of carrying out the direct flotation of such copper oxide ores which have been conventionally considered to be difficult to be subjected to flotation. The process of the present invention is effective, in principle, as a slag flotation process to recover copper minerals from not only copper oxide ores but also from copper sulfide ores or from artificial minerals such as copper smelter slag. As illustrated later in the Examples, the process of the present invention provides better results than conventional processes.

The process of the present invention comprises the steps of grinding ores containing copper minerals or copper smelter slags to a particle size capable of being subjected to the flotation of 48 mesh, conditioning the ground are by adding benzotriazole or alkyl benzotriazole to the ground product and then subjecting the conditioned ore to the flotation by adding thereto one or more collectors selected from the group consisting of xanthates, dithiophosphates, thiocarbamate esters, dithiocarbamates, mercaptans and dixanthogens and, if desired, with one or more promoters selected from the group consisting of kerosene, light oil, bunker oil and petroleum lubricants. A frother is required for producing froth and is added thereto in each case in a similar manner to conventional flotation practice.

Compounds which are usable as an activator have the following general formula:

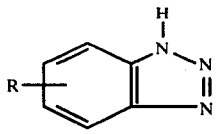

wherein R is selected from a group consisting of a hydrogen atom and a straight-chain or branched-chain alkyl group containing 1 to 20 carbon atoms, preferably at least 3 carbon atoms. Due to their strong affinity for the copper atom, they have been used coventionally as a corrosion inhibitor for copper. Such benzotriazole and alkyl benzotriazole include various isomers having the above-described formula. All of such isomers are also effective in the process of the present invention.

Collectors which are usable in the present invention include xanthates such as sodium-, potassium- and ammonium-xanthates and esters of xanthic acid; dithiophosphates such as sodium-, potassium- and ammonium-dithiophosphate; thiocarbamate esters; dithiocarbamates such as sodium-, potassium- and ammonium-dithiocarbamate and dithiocarbamate esters; mercaptans such as mercaptobenzothiazole and sodium-, potassium-, and ammonium-mercaptobenzothiazole; and dixanthogens.

According to the process of the present invention, a copper benzotriazole or copper alkyl benzotriazole in which benzotriazole or alkyl benzotriazole is coupled with copper atoms in the copper oxide ore, is produced on the surface of the ore by adding benzotriazole or alkyl benzotriazole to the ore. The coupling of copper atoms with benzotriazole or alkyl benzotriazole is important in the process of the present invention. The copper oxide ore with the surface thereof coated with copper benzotriazole or copper alkyl benzotriazole is subjected to the flotation by adding a collector such as xanthates and the like. If desired, the collecting effect of copper oxide particles is promoted by adding a hydrocarbon oil such as kerosene, light oil and the like. It is not clear why such a hydrocarbon oil is effective for the flotation, but it is assumed to be mainly due to the improved physical properties of the pulp such that the promoter changes the surface tension of the solution in the pulp to control particles coated with said copper benzotriazole or copper alkyl benzotriazole to the floatable conditions.

With the addition of only benzotriazole or alkyl benzotriazole or with the cooperative addition of benzotriazole or alkyl benzotriazole and a hydrocarbon oil such as kerosene, light oil or the like, most of the copper oxide ores still cannot be floated. Hence, it is important in the process of the present invention to add benzotriazole or alkyl benzotriazole, followed by adding a collector such as xanthates and the like to float the ground ores.

The process of the present invention is effective not only for the flotation of copper oxide ores, but also for the flotation of copper smelter slags. The commercialized flotation process of copper smelter slags is applied to the converter slag which contains mainly $Cu_2S$ and metallic copper. The process of the present invention provides an extremely effective procedure, particularly for collecting the metallic copper, and improves markedly the flotation performance when conventional xanthates are mainly employed as collectors. When the process of the present invention is applied to the flotation of copper sulfide ores, the flotation rate, i.e., the velocity at which copper sulfide minerals are recovered as the concentrate by the flotation is improved by adding benzotriazole or alkyl benzotriazole in an extremely small amount as compared to the conventional flotation employing xanthates. The improved flotation rate means that a lesser number of flotation cells are required and give a lower treating cost.

In the attached drawings.

EXAMPLE 1

The flotation has been carried out according to the conventional process and the process of the present invention, respectively, on a Chilean copper oxide ore consisting predominantly of copper oxide minerals. The results of tests of these processes are as follows.

Figure 1:
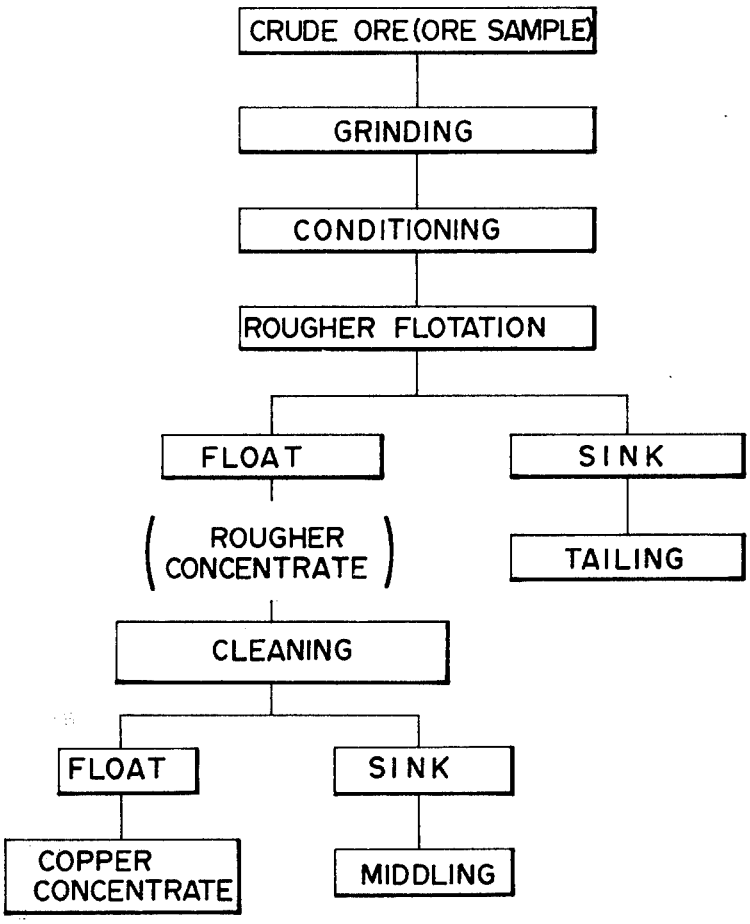
FIG. 1 is a flow diagram showing an embodiment of this invention.

The copper ore sample used in this example contained 2.6% by weight of copper and 0.28% by weight of sulfur. About 80% by weight of the copper was contained as nonsulfide copper minerals consisting mainly of crysocolla [$CuSiO_3.2H_2O$] and the remainder of about 20% by weight was contained as copper sulfide minerals of chalcocite [$Cu_2S$], bornite [$Cu_5FeS_4$] and the like. The sample ore was ground to an extent that about 60% by weight was passed through a 200 mesh screen. According to the flow diagram as shown in FIG. 1, the ground sample was conditioned for 5 minutes and then subjected to the rougher flotation for 20 minutes to obtain the rougher concentrate which was then subjected to the cleaning flotation for 10 minutes to obtain the copper concentrate. The pulp density in the rougher flotation was 25% by weight for all runs and that in the cleaning ranged from 4 to 8% by weight depending on the amount of rougher concentrates.

The pulp pH was not especially adjusted to be maintained as such. As the activator, 5-methyl benzotriazole or benzotriazole was employed. Table 1 shows the flotation conditions and Table 2 shows the results of flotation. In Run Nos. 2 to 5, 5-methyl benzotriazole was employed as the activator. In Run Nos. 6 to 9, benzotriazole was employed as the activator.

Table 1

| | Flotation conditions |
|---|---|
| I: | Amount of reagent, grams/ton |

Table 1-continued

| | |
|---|---|
| I-a: | Pine oil |
| I-b: | Sodium sulfide |
| I-c: | 5-methyl benzotriazole or benzotriazole |
| I-d: | Potassium amyl xanthate |
| I-e: | Kerosene |
| I-f: | Light oil |
| I-g: | Mobile oil No. 20 |
| II: | Pulp density, % solid by weight |
| III: | Pulp pH |
| IV: | Conditioning time or flotation time, minutes |
| V: | Conditioning |
| VI: | Rougher flotation |
| VII: | Cleaning |
| VIII: | Total |

| Run No. | Step | I | | | | | | | II | III | IV |
|---|---|---|---|---|---|---|---|---|---|---|---|
| | | I-a | I-b | I-c | I-d | I-e | I-f | I-g | | | |
| 1 | V | | | | | | | | 25 | | 5 |
| | VI | 90 | 900 | | 200 | | | | 25 | 9.2 | 20 |
| | VII | 10 | 100 | | 50 | | | | 4 | 9.1 | 10 |
| | VIII | 100 | 1000 | | 250 | | | | | | |
| 2 | V | | | 550 | | | | | 25 | | 5 |
| | VI | 75 | | | 150 | 400 | | | 25 | 8.0 | 20 |
| | VII | 25 | | 50 | 50 | 100 | | | 6 | 8.2 | 10 |
| | VIII | 100 | | 600 | 200 | 500 | | | | | |
| 3 | V | | | 550 | | | | | 25 | | 5 |
| | VI | 75 | | | 150 | | 400 | | 25 | 8.0 | 20 |
| | VII | 25 | | 50 | 50 | | 100 | | 8 | 8.2 | 10 |
| | VIII | 100 | | 600 | 200 | | 500 | | | | |
| 4 | V | | | 550 | | | | | 25 | | 5 |
| | VI | 75 | | | 150 | | | 400 | 25 | 8.0 | 20 |
| | VII | 25 | | 50 | 50 | | | 100 | 6 | 8.0 | 10 |
| | VIII | 100 | | 600 | 200 | | | 500 | | | |
| 5 | V | | | 550 | | | | | 25 | | 5 |
| | VI | 75 | | | 250 | | | | 25 | 8.0 | 20 |
| | VII | 25 | | 50 | 100 | | | | 5 | 8.2 | 10 |
| | VIII | 100 | | 600 | 350 | | | | | | |
| 6 | V | | | 550 | | | | | 25 | | 5 |
| | VI | 75 | | | 150 | 400 | | | 25 | 8.0 | 20 |
| | VII | 25 | | 50 | 50 | 100 | | | 6 | 8.0 | 10 |
| | VIII | 100 | | 600 | 200 | 500 | | | | | |
| 7 | V | | | 550 | | | | | 25 | | 5 |
| | VI | 75 | | | 150 | | 400 | | 25 | 8.0 | 20 |
| | VII | 25 | | 50 | 50 | | 100 | | 8 | 8.1 | 10 |
| | VIII | 100 | | 600 | 200 | | 500 | | | | |
| 8 | V | | | 550 | | | | | 25 | | 5 |
| | VI | 75 | | | 150 | | | 400 | 25 | 7.9 | 20 |
| | VII | 25 | | 50 | 50 | | | 100 | 6 | 8.1 | 10 |
| | VIII | 100 | | 600 | 200 | | | 500 | | | |
| 9 | V | | | 550 | | | | | 25 | | 5 |
| | VI | 75 | | | 250 | | | | 25 | 7.9 | 20 |
| | VII | 25 | | 50 | 100 | | | | 5 | 8.1 | 10 |
| | VIII | 100 | | 600 | 350 | | | | | | |
| | V | | | 550 | | | | | 25 | | 5 |
| | VI | 75 | | | | 400 | | | 25 | 8.0 | 20 |
| | VII | 25 | | 50 | | 100 | | | 5 | 8.2 | 10 |
| | VIII | 100 | | 600 | | 500 | | | | | |
| 11 | V | | | 550 | | | | | 25 | | 5 |
| | VI | 75 | | | | 400 | | | 25 | 7.9 | 20 |
| | VII | 25 | | 50 | | 100 | | | 5 | 8.1 | 10 |
| | VIII | 100 | | 600 | | 500 | | | | | |

Run No. 1: Conventional process
Run Nos. 2–9: Process of the present invention
Run Nos. 10–11: Reference process Table 2

| Run No. | Product | Results of flotation: Weight, % | Analysis, % by weight: Cu | Analysis, % by weight: S | Recovery, % by weight: Cu | Recovery, % by weight: S |
|---|---|---|---|---|---|---|
| 1 | Feed (Crude ore) | 100.0 | 2.75 | 0.32 | 100.0 | 100.0 |
| | Copper concentrate | 1.6 | 40.7 | 14.3 | 23.7 | 70.3 |
| | Middling | 2.5 | 4.57 | 0.80 | 4.1 | 6.1 |
| | (Rougher concentrate) | 4.1 | 18.7 | 6.07 | 27.8 | 76.4 |
| | Tailing | 95.9 | 2.07 | 0.08 | 72.2 | 23.6 |
| 2 | Feed (Crude ore) | 100.0 | 2.48 | 0.28 | 100.0 | 100.0 |
| | Copper concentrate | 7.2 | 21.8 | 2.96 | 63.3 | 74.1 |
| | Middling | 4.6 | 4.25 | 0.26 | 7.9 | 4.2 |
| | (Rougher concentrate) | 11.8 | 15.0 | 1.89 | 71.2 | 78.3 |
| | Tailing | 88.2 | 0.81 | 0.07 | 28.8 | 21.7 |
| 3 | Feed (Crude ore) | 100.0 | 2.57 | 0.28 | 100.0 | 100.0 |
| | Copper concentrate | 9.0 | 19.5 | 2.41 | 68.3 | 78.4 |
| | Middling | 5.9 | 4.16 | 0.29 | 9.5 | 6.2 |
| | (Rougher concentrate) | 14.9 | 13.4 | 1.57 | 77.8 | 84.6 |
| | Tailing | 85.1 | 0.67 | 0.05 | 22.2 | 15.4 |

Table 2-continued

| Run No. | Product | Results of flotation: Weight, % | Analysis, % by weight: Cu | S | Recovery, % by weight: Cu | S |
|---|---|---|---|---|---|---|
| 4 | Feed (Crude ore) | 100.0 | 2.52 | 0.28 | 100.0 | 100.0 |
| | Copper concentrate | 7.6 | 21.1 | 2.70 | 63.7 | 73.6 |
| | Middling | 4.2 | 3.91 | 0.28 | 6.5 | 4.2 |
| | (Rougher concentrate) | 11.8 | 15.0 | 1.84 | 70.2 | 77.8 |
| | Tailing | 88.2 | 0.85 | 0.07 | 29.8 | 22.2 |
| 5 | Feed (Crude ore) | 100.0 | 2.52 | 0.29 | 100.0 | 100.0 |
| | Copper concentrate | 7.1 | 21.7 | 3.07 | 61.2 | 75.2 |
| | Middling | 3.5 | 3.88 | 0.27 | 5.4 | 3.2 |
| | (Rougher concentrate) | 10.6 | 16.7 | 2.14 | 66.6 | 78.4 |
| | Tailing | 89.4 | 0.94 | 0.07 | 33.4 | 21.6 |
| 6 | Feed (Crude ore) | 100.0 | 2.49 | 0.29 | 100.0 | 100.0 |
| | Copper concentrate | 7.1 | 21.5 | 3.13 | 61.4 | 75.4 |
| | Middling | 4.4 | 4.35 | 0.24 | 7.7 | 3.6 |
| | (Rougher concentrate) | 11.5 | 14.9 | 2.02 | 69.1 | 79.0 |
| | Tailing | 88.5 | 0.87 | 0.07 | 30.9 | 21.0 |
| 7 | Feed (Crude ore) | 100.0 | 2.52 | 0.27 | 100.0 | 100.0 |
| | Copper concentrate | 9.6 | 18.4 | 2.24 | 70.1 | 79.6 |
| | Middling | 6.3 | 3.17 | 0.21 | 7.9 | 4.9 |
| | (Rougher concentrate) | 15.9 | 12.4 | 1.44 | 78.0 | 84.5 |
| | Tailing | 84.1 | 0.66 | 0.05 | 22.0 | 15.5 |
| 8 | Feed (Crude ore) | 100.0 | 2.56 | 0.28 | 100.0 | 100.0 |
| | Copper concentrate | 7.5 | 21.8 | 2.76 | 63.8 | 74.0 |
| | Middling | 4.0 | 3.72 | 0.27 | 5.8 | 3.9 |
| | (Rougher concentrate) | 11.5 | 15.5 | 1.89 | 69.6 | 77.9 |
| | Tailing | 88.5 | 0.88 | 0.07 | 30.4 | 22.1 |
| 9 | Feed (Crude ore) | 100.0 | 2.56 | 0.28 | 100.0 | 100.0 |
| | Copper concentrate | 6.9 | 22.2 | 2.99 | 59.4 | 73.8 |
| | Middling | 3.6 | 4.44 | 0.27 | 6.2 | 8.5 |
| | (Rougher concentrate) | 10.5 | 16.1 | 2.06 | 65.6 | 77.3 |
| | Tailing | 89.5 | 0.99 | 0.07 | 34.4 | 22.7 |
| 10 | Feed (Crude ore) | 100.0 | 2.56 | 0.29 | 100.0 | 100.0 |
| | Copper concentrate | 3.4 | 29.3 | 6.21 | 38.9 | 73.9 |
| | Middling | 4.2 | 5.77 | 0.24 | 9.5 | 3.5 |
| | (Rougher concentrate) | 7.6 | 16.3 | 2.91 | 48.4 | 77.4 |
| | Tailing | 92.4 | 1.43 | 0.07 | 51.6 | 22.6 |
| 11 | Feed (Crude ore) | 100.0 | 2.60 | 0.27 | 100.0 | 100.0 |
| | Copper concentrate | 3.3 | 29.9 | 6.19 | 38.0 | 75.6 |
| | Middling | 4.2 | 5.48 | 0.25 | 8.9 | 3.9 |
| | (Rougher concentrate) | 7.5 | 16.2 | 2.86 | 46.9 | 79.5 |
| | Tailing | 92.5 | 1.49 | 0.06 | 53.1 | 20.5 |

As shown in Table 2, in Run No. 1 in which the surface of the ground ore was converted to the sulfide by means of sodium sulfide in a conventional method, the copper recovery in the concentrate was only 23.7% and that in the rougher concentrate was only 27.8%. Substantially no nonsulfide copper minerals were recovered, only copper sulfide minerals being recovered. On the contrary, in Run Nos. 2, 3 and 4 in which 5-methylbenzotriazole and potassium amyl xanthate were employed in combination with kerosene, light oil or lubricant oil, the copper recovery in the concentrate was 63.3%, 68.3% and 63.7%, respectively, and the copper recovery in the rougher concentrate was 71.2%, 77.8% and 70.2%, respectively. In Run Nos. 6, 7 and 8 in which benzotriazole and potassium amyl xanthate were employed in combination with kerosene, light oil or lubricant oil, the copper recovery in the concentrate was 61.4%, 70.1% and 63.8% respectively, and the copper recovery in the rougher concentrate was 69.1%, 78.0% and 69.6%, respectively. Thus, the copper recovery was improved drastically as compared with that for Run No. 1 thereby showing the recovery of crysocolla, that is, a nonsulfide copper mineral contained mainly in the sample. Moreover, in Run Nos. 5 and 9 in which 5-methyl benzotriazole or benzotriazole and potassium amyl xanthate were employed without a promoter, the results were inferior to some extent to those obtained in Run Nos. 2 to 4 and Nos. 6 to 8, but improved markedly as compared with that obtained in Run No. 1. Thus, the combination of 5-methyl benzotriazole or benzotriazole and potassium amyl xanthate can recover the copper mineral contained in crysocolla by flotation. Thus, it has been proved that the process of the present invention is effective for the recovery of nonsulfide copper minerals.

Moreover, Run Nos. 10 and 11 in which 5-methyl benzotriazole or benzotriazole was employed in combination with kerosene achieved higher copper recoveries than that achieved in Run No. 1, but were far below than those achieved in Run Nos. 2 to 9.

EXAMPLE 2 (Run No. 12)

This example illustrates the application of process of the present invention to a Chilean copper oxide ore consisting mainly of copper oxide minerals and is different from the ore employed in Example 1.

The copper mineral contained in the ore was brochantite [$Cu_4(SO_4)(OH)_6$], a nonsulfide copper mineral and contained substantially no copper sulfide mineral. The ore sample contained 2.22% by weight of copper.

Figure 2:
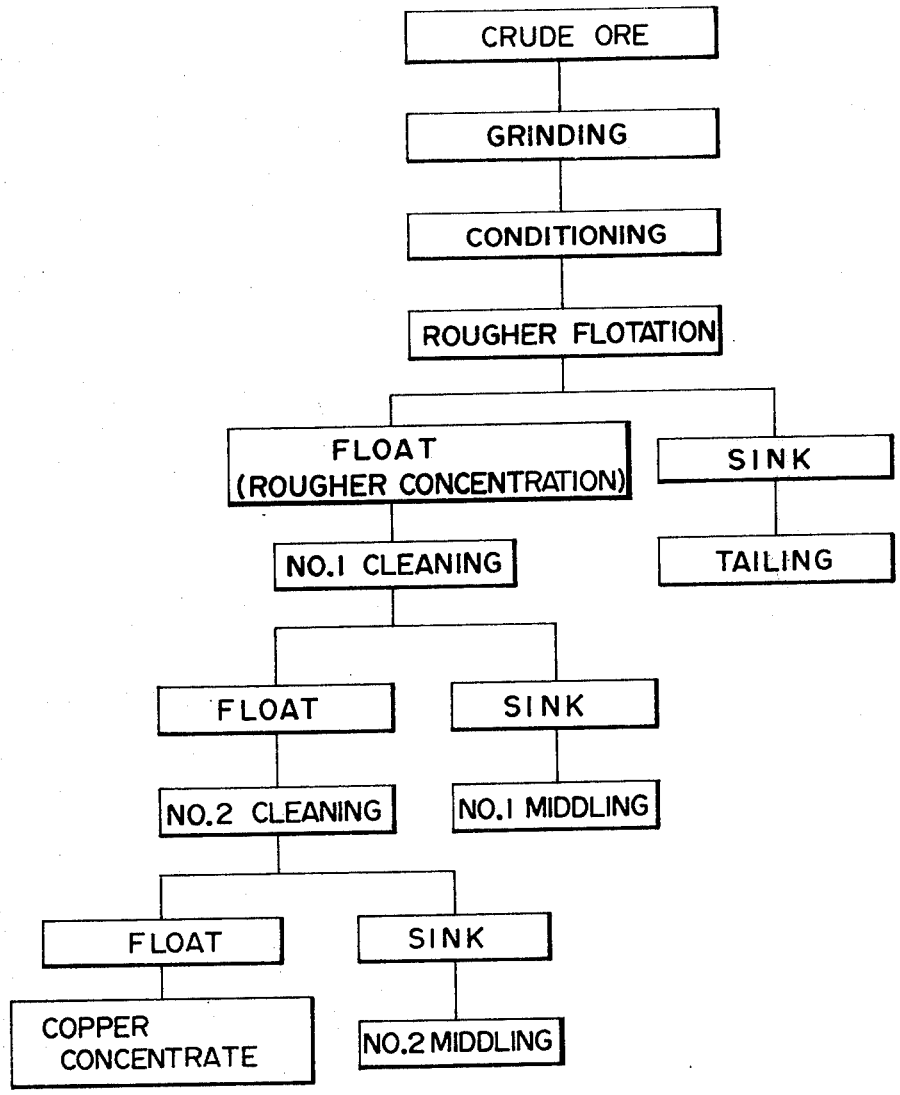
FIG. 2 is a flow diagram showing another embodiment of this invention.

The ore sample was ground to an extent than 55% by weight of ground product passed through a 200 mesh screen. According to the flow diagram as illustrated in FIG. 2, the ground product was conditioned for 5 minutes and then subjected to the rougher flotation for 20 minutes. The resulting floated fraction (rougher concentrate) was then subjected to cleaning twice for 15 minutes and 10 minutes, respectively. The pH of pulp was not particularly adjusted or maintained as such.

As the floating reagents, the frother was pine oil and the collectors for recovering brochantite were 4-methyl benzotriazole, potassium amyl xanthate and light oil.

Table 3 shows the flotation conditions and Table 4 shows the flotation results.

Table 3

| | Flotation conditions: Conditioning | Rougher flotation | Cleaning | Total |
|---|---|---|---|---|
| Amount of reagents grams/ton | | | | |
| Pine oil | | 40 | 20 | 60 |
| 4-methyl benzotriazole | 300 | | 50 | 350 |
| Potassium amyl xanthate | | 50 | 20 | 70 |
| Light oil | | 250 | 100 | 350 |
| Pulp density, % solid by wt. | 25 | 25 | 10.5 | |
| Pulp pH | | 8.1 | 8.1 | |
| Flotation time, minutes | 5 | 20 | 15 + 10 | |

Table 4

| Product | Flotation results: Weight % by weight | Analysis of copper, % by weight | Copper recovery, % |
|---|---|---|---|
| Feed (Crude ore) | 100.0 | 2.22 | 100.0 |
| Copper concentrate | 5.3 | 30.7 | 73.1 |
| No. 2 Middling | 1.7 | 4.82 | 3.7 |
| No. 1 Middling | 7.0 | 2.33 | 7.3 |
| Tailing | 86.0 | 0.41 | 15.9 |

Copper concentrate +

Table 4-continued

| Product | Flotation results: Weight % by weight | Analysis of copper, % by weight | Copper recovery, % |
|---|---|---|---|
| No. 2 Middling | 7.0 | 24.4 | 76.8 |
| Rougher concentrate | 14.0 | 13.3 | 84.1 |

As shown in Table 4, the copper concentrate having a analysis of 30.7% by weight of copper could be obtained from the crude ore having a analysis of 2.22% by weight of copper, i.e., a recovery of 73.1% by the process of the present invention, the recovery of rougher concentrate being 84.1%. Thus for the present ore sample, brochantite contained in the sample ore could be recovered by the flotation process of the present invention.

EXAMPLE 3 (Run No. 13)

An ore sample having a analysis of 2.1% by weight of copper was subjected to the flotation process of Example 2 illustrated by FIG. 2. This example was slightly different from the process of Example 2, benzotriazole, potassium amyl xanthate and light oil were employed as the reagents.

Table 5 shows the flotation conditions of this example and Table 6 shows the results of flotation.

Table 5

| Step | Flotation conditions: Conditioning | Rougher flotation | Cleaning | Total |
|---|---|---|---|---|
| Amount of reagents grams/ton | | | | |
| Pine oil | | 40 | 20 | 60 |
| Benzotriazole | 300 | | 50 | 350 |
| Potassium amyl xanthate | | 50 | 20 | 70 |
| Light oil | | 250 | 100 | 350 |
| Pulp density, % solid by wt. | 25 | 25 | 10.5 | |
| Pulp pH | | 7.8 | 8.0 | |
| Flotation time, minutes | 5 | 20 | 15 + 10 | |

Table 6

| Product | Flotation results: Weight, % by weight | Copper analysis, % by weight | Copper recovery, % |
|---|---|---|---|
| Feed (Crude ore) | 100.0 | 2.18 | 100.0 |
| Copper concentrate | 5.1 | 30.3 | 70.8 |
| No. 2 Middling | 1.3 | 5.10 | 3.0 |
| No. 1 Middling | 7.3 | 2.74 | 9.2 |
| Tailing | 86.3 | 0.43 | 17.0 |
| Concentrate + No. 2 Middling | 6.4 | 25.2 | 73.8 |
| Rougher concentrate | 13.7 | 13.2 | 83.0 |

As shown in Table 6, according to the process of the present invention, the concentrate having a analysis of 30.3% by weight of copper was obtained from the crude ore having a analysis of 2.18% by weight of copper, i.e., a recovery of 70.8%. Thus, it has been proved for this special ore sample that brochantite can be recovered easily by the flotation process of the present invention.

EXAMPLE 4 (Run No. 14)

This example illustrates an example in which the process of the present invention is applied to a Peruvian copper oxide ore.

About 90% by weight of copper mineral contained in the ore sample was relatively pure crysocolla [$CuSiO_3 \cdot 2H_2O$] and the remainder of about 10% by weight was malachite [$Cu_2(CO_3)(OH)_2$]. Most of the gangue therein was quartziferous and there was substantially no fine slime component. The analysis of copper was 13.9% by weight.

The ore sample was ground to an extent that 70% by weight of the resulting product was passed through a 200 mesh screen. According to the process as shown in FIG. 1, the ground ore was conditioned for 5 minutes and then subjected to the rougher flotation for 20 minutes. The resulting rougher concentrate was subjected to cleaning for 10 minutes. No particular adjustment of the pulp pH was effected.

Pine oil was employed as the frother and 5-methyl benzotriazole, potassium amyl xanthate and light oil were employed as the flotation reagents. Table 7 shows the flotation conditions and Table 8 the results obtained by the flotation.

Table 7

| Step | Flotation conditions: Conditioning | Rougher flotation | Cleaning | Total |
|---|---|---|---|---|
| Amount of reagents grams/ton | | | | |
| Pine oil | | 200 | 50 | 250 |
| 5-methyl benzotriazole | 550 | | 150 | 700 |
| Potassium amyl xanthate | | 150 | 50 | 200 |
| Light oil | | 500 | 200 | 700 |
| Pulp density, % solid by wt. | 25 | 25 | 12 | |
| Pulp pH | | 8.1 | 8.1 | |
| Flotation time, minutes | 5 | 20 | 10 | |

Table 8

| Product | Results obtained by flotation: Weight, % by weight | Copper analysis, % by weight | Copper recovery, % |
|---|---|---|---|
| Feed (Crude ore) | 100.0 | 13.9 | 100.0 |
| Copper concentrate | 52.1 | 25.3 | 94.9 |
| Middling | 16.4 | 4.08 | 4.8 |
| Tailing | 31.5 | 0.14 | 0.3 |
| Rougher concentrate | 68.5 | 20.2 | 99.7 |

EXAMPLE 5 (Run No. 15)

An ore sample containing copper in a analysis of 13.7% by weight was subjected to the flotation of Example 4 as illustrated by FIG. 1. In this example, benzotriazole, potassium amyl xanthate and light oil were employed as the flotation reagents.

Table 9 shows the flotation conditions and Table 10 shows the results obtained by the flotation.

Table 9

| Step | Flotation conditions: Conditioning | Rougher flotation | Cleaning | Total |
|---|---|---|---|---|
| Amount of reagents grams/ton | | | | |
| Pine oil | | 200 | 50 | 250 |
| Benzotriazole | 550 | | 150 | 700 |

Table 9-continued

| Step | Flotation conditions: Conditioning | Rougher flotation | Cleaning | Total |
|---|---|---|---|---|
| Potassium amyl xanthate | | 150 | 50 | 200 |
| Light oil | | 500 | 200 | 700 |
| Pulp density % solid by wt. | 25 | 25 | 12 | |
| Pulp pH | | 8.1 | 8.0 | |
| Flotation time, minutes | 5 | 20 | 10 | |

Table 10

| Product | Results obtained by flotation: Weight, % by weight | Copper analysis, % by weight | Copper recovery % |
|---|---|---|---|
| Feed (Crude ore) | 100.0 | 13.7 | 100.0 |
| Copper concentrate | 50.7 | 25.8 | 95.5 |
| Middling | 17.7 | 3.22 | 4.2 |
| Tailing | 31.6 | 0.15 | 0.3 |
| Rougher concentrate | 68.4 | 20.0 | 99.7 |

As shown in Tables 8 and 10, for relatively pure nonsulfide copper minerals without slime, it has been confirmed that crysocolla, which has been considered extremely difficult to subject to the conventional flotation process, can be recovered easily in an amount of more than 99% and it can be recovered essentially by the flotation process of the present invention.

This example illustrates an application of the present invention to an Australian copper oxide ore.

About 90% of the copper minerals contained in the ore sample was malachite [$Cu_2(CO_3)(OH)_2$] and the remainder of about 10% was contained as crysocolla [$CuSiO_3.2H_2O$], but no copper oxide mineral was substantially contained. The gangue contained a fine slime component. The copper analysis of sample was 9.6% by weight.

The sample ore was ground to an extent that 62% by weight of the resulting product passed through a 200 mesh screen. According to the process illustrated in FIG. 1, the ground sample was conditioned for 5 minutes and then subjected to the rougher flotation for 30 minutes. The resulting concentrate was subjected to cleaning for 10 minutes.

The ore sample contained a fine slime component but no removal of the slime was effected and the sample was subjected to the flotation as such. The adjustment of pulp pH was not particularly effected.

Pine oil was employed as the frother and 5-ethyl benzotriazole, potassium amyl xanthate and gas oil were employed as activator, collector and promoter for collecting the copper mineral.

Table 11 shows the flotation conditions and Table 12 shows the result obtained.

Table 11

| Step | Flotation conditions: Conditioning | Rougher flotation | Cleaning | Total |
|---|---|---|---|---|
| Amount of reagents grams/ton | | | | |
| Pine oil | | 120 | 60 | 180 |
| 5-ethyl benzotriazole | 550 | | 150 | 700 |
| Potassium amyl xanthate | | 150 | 50 | 200 |
| Light oil | | 600 | 150 | 750 |
| Pulp density, % solid by wt. | 25 | 25 | 10 | |
| Pulp pH | | 8.2 | 8.3 | |

Table 11-continued

| Step | Flotation conditions: Conditioning | Rougher flotation | Cleaning | Total |
|---|---|---|---|---|
| Flotation time, minutes | 5 | 30 | 10 | |

Table 12

| Product | Results obtained by flotation: Weight, % by weight | Copper analysis, % by weight | Copper recovery, % |
|---|---|---|---|
| Feed (Crude ore) | 100.0 | 9.64 | 100.0 |
| Copper concentrate | 44.4 | 20.0 | 92.1 |
| Middling | 10.2 | 2.71 | 2.9 |
| Tailing | 45.4 | 1.06 | 5.0 |
| Rougher concentrate | 54.6 | 16.8 | 95.0 |

The sample ore contained a fine reddish brown slime but even when no removal of slime was effected and the sample was subjected directly to the flotation, a copper recovery of 95% could be achieved in the rougher flotation as shown in Table 12. It has been confirmed, therefore, that even when slime is contained in the flotation pulp to some extent, crysocolla can be recovered by the flotation process of the present invention.

EXAMPLE 7

This example employed copper converter slag and shows a comparison of results obtained by a conventional flotation process and by the flotation process of this invention.

The copper in the converter copper slag is contained mainly in the forms of $Cu_2S$ and metallic copper. The test sample contained 4.95% by weight of copper.

Figure 3:
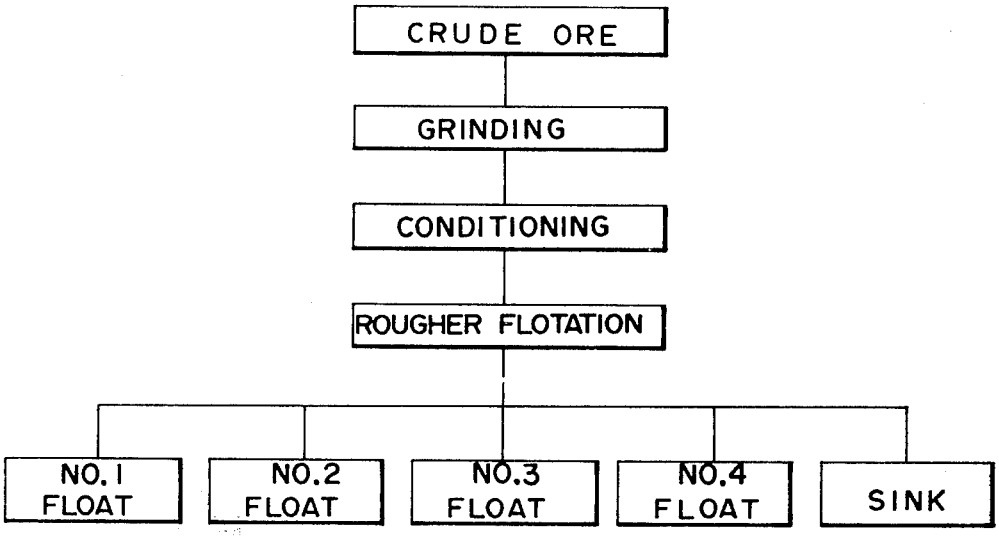
FIG. 3 is a flow diagram illustrating still another embodiment of this invention.

In the flotation test, the test sample was ground to an extent that about 90% by weight passed through a 325 mesh screen and the pulp density was adjusted to 35% solid by weight. According to the process as shown in FIG. 3, the ground sample was conditioned for 5 minutes and then subjected to the flotation to collect the floats during predetermined intervals.

Figure 4:
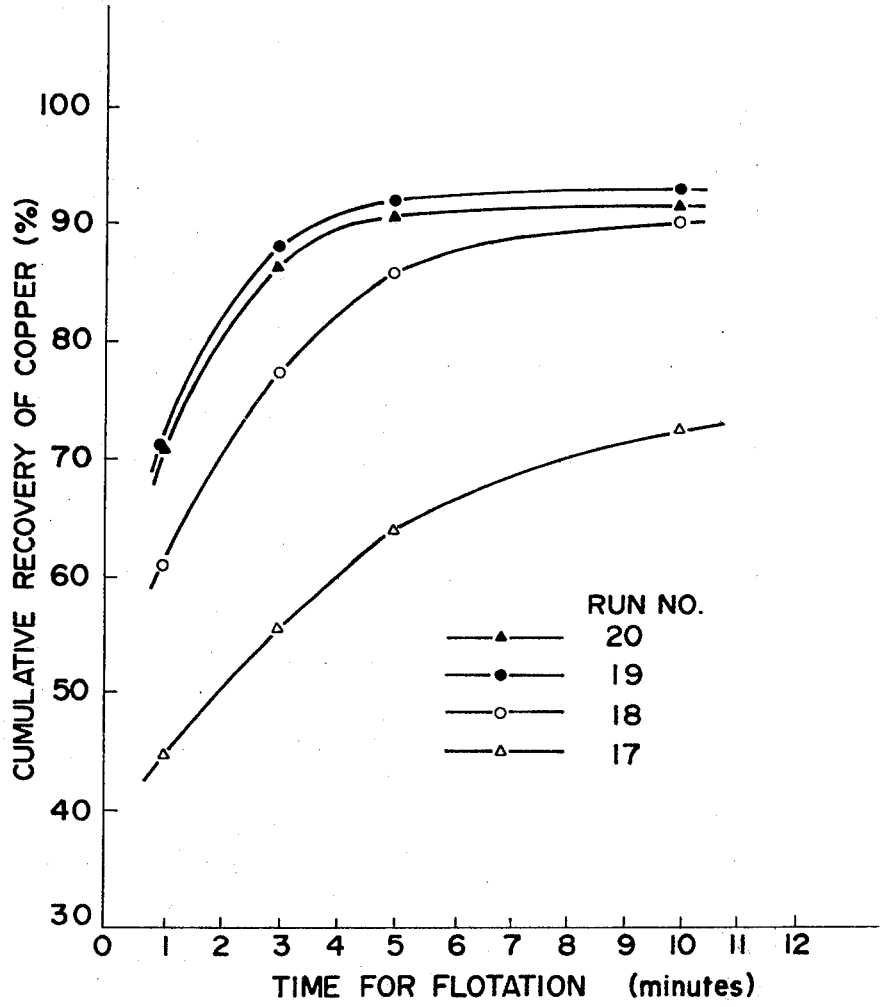
FIG. 4 shows a comparison of the flotation performance when benzotriazole or alkyl benzotriazole is employed as the activator and that or the conventional technique.

Table 13 shows the addition of reagents in conventional processes and in the process of the present invention. Table 14 and FIG. 4 show the results obtained in each case.

Table 13

| Run No. | Reagent | Kind, position added and amount in grams/ton of reagents: Conditioning | Rougher flotation No. 1 0–1 min | No. 2 1–3 min | No. 3 3–5 min | No. 4 5–10 min | Total |
|---|---|---|---|---|---|---|---|
| 17 | Pine oil | — | 20 | — | — | 20 | 40 |
| | Potassium amyl xanthate | 50 | — | 20 | 20 | 10 | 100 |
| 18 | Pine oil | — | 20 | — | — | 20 | 40 |
| | Isopropyl ethyl thiocarbamate * | 50 | — | — | — | 50 | 100 |
| 19 | Pine oil | — | 20 | — | — | 20 | 40 |
| | 5-methylbenzotriazole | 10 | — | — | — | — | 10 |
| | Isopropyl ethyl thiocarbamate * | 25 | — | — | — | — | 25 |
| 20 | Pine oil | — | 20 | — | — | 20 | 40 |
| | Benzotriazole | 10 | — | — | — | — | 10 |

Table 13-continued

| Run No. | Reagent | Kind, position added and amount in grams/ton of reagents: Conditioning | Rougher flotation No. 1 0–1 min | No. 2 1–3 min | No. 3 3–5 min | No. 4 5–10 min | Total |
|---|---|---|---|---|---|---|---|
| | Isopropyl ethyl thiocarbamate * | 25 | — | — | — | — | 25 |

* Reagent Z-200 available from Dow Chemical Co.
Run Nos. 17 and 18: Conventional process
Run Nos. 19 and 20: Process of the present invention Table 14

Results obtained by the flotation

I: Run No.
II: Product
III: Amount of product, % by weight
IV: Cumulative amount of product, % by weight
V: Analysis, % by weight of copper
VI: Analysis of cumulative product, % by weight of copper
VII: Copper recovery, %
VIII: Cumulative copper recovery
II-1: Feed (slag)
II-2: Float No. 1
II-3: Float No. 2
II-4: Float No. 3
II-5: Float No. 4
II-6: Sinks

| I | II | III | IV | V | VI | VII | VIII |
|---|---|---|---|---|---|---|---|
| 17 | II-1 | 100.0 | | 4.95 | | 100.0 | |
| | II-2 | 7.6 | 7.6 | 29.0 | 29.0 | 44.5 | 44.5 |
| | II-3 | 2.6 | 10.2 | 20.9 | 26.9 | 11.0 | 55.5 |
| | II-4 | 2.4 | 12.6 | 17.1 | 25.1 | 8.3 | 63.8 |
| | II-5 | 3.1 | 15.7 | 13.9 | 22.8 | 8.7 | 72.5 |
| | II-6 | 84.3 | | 1.61 | | 27.5 | |
| 18 | II-1 | 100.0 | | 4.99 | | 100.0 | |
| | II-2 | 6.1 | 6.1 | 50.1 | 50.1 | 61.2 | 61.2 |
| | II-3 | 2.5 | 8.6 | 32.7 | 45.0 | 16.4 | 77.6 |
| | II-4 | 2.1 | 10.7 | 19.5 | 40.0 | 8.2 | 85.8 |
| | II-5 | 2.7 | 13.4 | 8.5 | 33.7 | 4.6 | 90.4 |
| | II-6 | 86.6 | | 0.55 | | 9.6 | |
| 19 | II-1 | 100.0 | | 4.97 | | 100.0 | |
| | II-2 | 9.4 | 9.4 | 37.5 | 37.5 | 71.0 | 71.0 |
| | II-3 | 3.7 | 13.1 | 23.1 | 33.4 | 17.2 | 88.2 |
| | II-4 | 1.8 | 14.9 | 10.3 | 30.6 | 3.7 | 91.9 |
| | II-5 | 2.3 | 17.2 | 2.7 | 26.9 | 1.3 | 93.2 |
| | II-6 | 82.8 | | 0.41 | | 6.8 | |
| 20 | II-1 | 100.0 | | 4.93 | | 100.0 | |
| | II-2 | 9.0 | 9.0 | 38.2 | 38.2 | 69.7 | 69.7 |
| | II-3 | 3.6 | 12.6 | 24.4 | 34.2 | 17.8 | 87.5 |
| | II-4 | 2.1 | 14.7 | 9.24 | 30.7 | 3.9 | 91.4 |
| | II-5 | 2.4 | 17.1 | 2.80 | 26.8 | 1.4 | 92.8 |
| | II-6 | 82.9 | | 0.43 | | 7.2 | |

As shown in FIG. 4, in comparison with the conventional process according to Run No. 17 in which a xanthate was employed or Run No. 18 in which Z-200 was employed, the process of the present invention according to Run No. 19 in which 5-methyl benzotriazole and Z-200 were employed and Run No. 20 in which benzotriazole and Z-200 were employed provides higher flotation rates at the initial stage. Higher copper recoveries were also achieved in Run Nos. 19 and 20 than in Run Nos. 17 and 18.

EXAMPLE 8

This example shows a comparison of the flotation results for a Japanese copper-bearing pyrite ore by the process according to the present invention and conventional processes.

Copper minerals contained in the ore sample consisted mainly of chalcopyrite [$CuFeS_2$] and the ore contained pyrite [$FeS_2$] in a large amount. The ore contained 2.8% by weight of copper and 39% by weight of sulfur.

The ore sample was ground to a extent that 60% by weight was passed through a 200 mesh screen. The ground sample was made up to pulp having a density of about 35% solid by weight. The pulp was conditioned for 5 minutes and then subjected to the flotation for 10 minutes to separate the float and sink. The pH of the pulp was not adjusted as such. Table 15 shows the type and amount of reagents employed.

Table 15

| Run No. | Process | Type and amount of reagents: Kind of reagents | Amount |
|---|---|---|---|
| 21 | Conventional process | Pine oil (frother) | 40 |
| | | Potassium amyl xanthate | 1 |
| | | Z-200 | 20 |
| 22 | Process according to the present invention | Pine oil (frother) | 40 |
| | | 5-Methylbenzotriazole | 1 |
| | | Z-200 | 20 |
| 23 | Process according to the present invention | Pine oil (frother) | 40 |
| | | Benzotriazole | 1 |
| | | Z-200 | 20 |
| 24 | Conventional process | Pine oil (frother) | 40 |
| | | Potassium amyl xanthate | 10 |
| | | Z-200 | 20 |
| 25 | Process according to the present invention | Pine oil (frother) | 40 |
| | | 5-Methylbenzotriazole | 10 |
| | | Z-200 | 20 |
| 26 | Process according to the present invention | Pine oil (frother) | 40 |
| | | Benzotriazole | 10 |
| | | Z-200 | 20 |

Table 16 shows the results obtained by the flotation.

Table 16

| Run No. | Product | Results obtained by flotation: % by weight | Analysis % by weight Cu | S | Recovery % Cu | S |
|---|---|---|---|---|---|---|
| 21 | Feed | 100.0 | 2.80 | 38.6 | 100.0 | 100.0 |
| | Float | 32.6 | 7.87 | 45.4 | 91.6 | 38.3 |
| | Sink | 67.4 | 0.35 | 35.3 | 8.4 | 61.7 |
| 22 | Feed | 100.0 | 2.83 | 38.7 | 100.0 | 100.0 |
| | Float | 43.1 | 6.12 | 46.2 | 93.2 | 51.5 |
| | Sink | 56.9 | 0.34 | 33.0 | 6.8 | 48.5 |
| 23 | Feed | 100.0 | 2.82 | 39.0 | 100.0 | 100.0 |
| | Float | 42.0 | 6.25 | 46.0 | 93.1 | 49.5 |
| | Sink | 58.0 | 0.34 | 33.9 | 6.9 | 50.5 |
| 24 | Feed | 100.0 | 2.82 | 38.7 | 100.0 | 100.0 |
| | Float | 42.4 | 6.05 | 46.8 | 94.2 | 51.3 |
| | Sink | 57.6 | 0.28 | 32.7 | 5.8 | 48.7 |
| 25 | Feed | 100.0 | 2.81 | 38.5 | 100.0 | 100.0 |
| | Float | 60.2 | 4.53 | 49.2 | 97.0 | 76.9 |
| | Sink | 39.8 | 0.21 | 22.4 | 3.0 | 23.1 |
| 26 | Feed | 100.0 | 2.79 | 38.5 | 100.0 | 100.0 |
| | Float | 61.3 | 4.42 | 48.4 | 97.1 | 77.1 |
| | Sink | 38.7 | 0.21 | 22.8 | 2.9 | 22.9 |

The comparison was effected by the combination of potassium amyl xanthate and Z-200 and the combination of 5-methyl benzotriazole or benzotriazole and Z-200 and effected in two levels of 1 gram/ton and 10 grams/ton of 5-methyl benzotriazole or benzotriazole. In the two levels, the copper recovery was higher in the combination of 5-methyl benzotriazole or benzotriazole and Z-200 than that in the combination of potassium amyl xanthate and Z-200.

In the above examples, there have been illustrated embodiments employing xanthates or thiocarbamate esters as the collector and kerosene, light oil or lubricant oil as the promoter. Similar results were obtained in embodiments employing a dithiophosphate, dithiocarbamate, mercaptan or dixanthogen as the collector and bunker oil as the promoter.

What is claimed is:

1. A flotation process for copper ores and copper smelter slag comprising grinding copper-bearing material, adding a compound of the following formula:

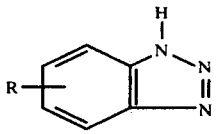

wherein R represents one member selected from the group consisting of hydrogen atom and alkyl groups containing 1 to 20 carbon atoms to the resulting ground material and further adding at least one member selected from the group consisting of xanthates, dithiophosphates, thiocarbamate esters, dithiocarbamates, mercaptans and dixanthogens as a collector.

2. A process according to claim 1 comprising further adding at least one member selected from the group consisting of kerosene, light oil, bunker oil and petroleum lubricant to said ground material.

3. A process according to claim 1 wherein said material is ground to form a particle size of finer than 48 mesh.

4. A process according to claim 1 comprising adding a frother to said ground material.

5. A process according to claim 1 in which said xanthate is one member selected from the group consisting of sodium-, potassium- and ammonium-salt of xanthic acid and esters of xanthic acid.

6. A process according to claim 1 in which said dithiophosphate is one member selected from the group consisting of sodium-, potassium- and ammonium-salt of dithiophosphoric acid.

7. A process according to claim 1 in which said dithiocarbamate is one member selected from the group consisting of sodium-, potassium- and ammonium-salt of dithiocarbamic acid and dithiocarbamate esters.

8. A process according to claim 1 in which said mercaptan is one member selected from the group consisting of mercapto-benzothiazole and sodium-, potassium- and ammonium-salt thereof.

9. A process according to claim 1 wherein said R is an alkyl group composed of 3 to 20 carbon atoms and selected from the group consisting of straight chain and branched chain.

* * * * *